US005971308A

United States Patent [19]

Boulton

[11] Patent Number: 5,971,308

[45] Date of Patent: Oct. 26, 1999

[54] WIRE TRANSFER ASSEMBLY

[75] Inventor: Norman B. Boulton, Granger, Ind.

[73] Assignee: National-Standard Company, Niles, Mich.

[21] Appl. No.: 09/034,476

[22] Filed: Mar. 4, 1998

[51] Int. Cl.[6] ..... B65H 49/02; B65H 23/00

[52] U.S. Cl. ..... 242/131; 242/128; 242/566

[58] Field of Search ..... 242/131, 157.1, 242/157 R, 566, 615.3, 128, 129

[56] References Cited

U.S. PATENT DOCUMENTS

| | | | |
|---|---|---|---|
| 986,020 | 3/1911 | Mills | 242/128 |
| 1,830,449 | 11/1931 | Swank | 242/128 |
| 1,834,159 | 12/1931 | King, Jr. et al. . | |
| 2,360,741 | 10/1944 | Symmes | 242/566 X |
| 2,774,548 | 12/1956 | Hanson | 242/128 |
| 2,784,921 | 3/1957 | Washabaugh | 242/128 |
| 2,842,323 | 7/1958 | Rayburn . | |
| 2,880,305 | 3/1959 | Baird . | |
| 2,929,575 | 3/1960 | Kovalaeski . | |
| 2,942,802 | 6/1960 | Bachus | 242/128 |
| 2,944,755 | 7/1960 | Foster . | |
| 3,010,674 | 11/1961 | Dull et al. . | |
| 3,298,631 | 1/1967 | Richardson, Jr. . | |
| 3,425,647 | 2/1969 | Kovaleski et al. . | |
| 3,556,370 | 1/1971 | Strozewski . | |
| 3,567,152 | 3/1971 | Heisler . | |
| 3,717,315 | 2/1973 | Kovalski . | |
| 3,972,489 | 8/1976 | Kovaleski . | |
| 3,976,259 | 8/1976 | Newberry et al. . | |
| 3,997,127 | 12/1976 | Kovaleski . | |
| 3,998,403 | 12/1976 | Kovaleski . | |
| 4,017,037 | 4/1977 | Kovaleski . | |
| 4,055,314 | 10/1977 | Kovaleski . | |
| 4,062,505 | 12/1977 | Kovaleski . | |
| 4,140,289 | 2/1979 | Kovaleski . | |
| 4,171,783 | 10/1979 | Waltermath | 242/128 |
| 4,269,371 | 5/1981 | Kovaleski . | |
| 4,298,174 | 11/1981 | Kovaleski . | |
| 4,377,264 | 3/1983 | Kovaleski . | |
| 4,396,168 | 8/1983 | Hilt et al. . | |
| 4,441,692 | 4/1984 | Kovaleski . | |
| 4,482,340 | 11/1984 | Kovaleski . | |
| 4,508,290 | 4/1985 | Bauer . | |
| 4,572,458 | 2/1986 | Bluhm et al. . | |
| 4,768,364 | 9/1988 | Kovaleski et al. . | |
| 5,007,597 | 4/1991 | Jones . | |
| 5,040,741 | 8/1991 | Brown . | |
| 5,277,314 | 1/1994 | Cooper et al. . | |

*Primary Examiner*—Michael R. Mansen
*Attorney, Agent, or Firm*—Emrich & Dithmar

[57] ABSTRACT

A wire dereeling assembly for the continuous removal of wire from adjacent reels of wire includes a frame assembly positioned above the reels and located substantially perpendicular to a centerline extending through the reel axis of each of the reels and a guide member slidably mounted to the frame member and operable between a first position substantially coaxial with the reel axis of one of the reels and a second position where the guide member is positioned substantially coaxial with the reel axis of the other adjacent reel.

18 Claims, 10 Drawing Sheets

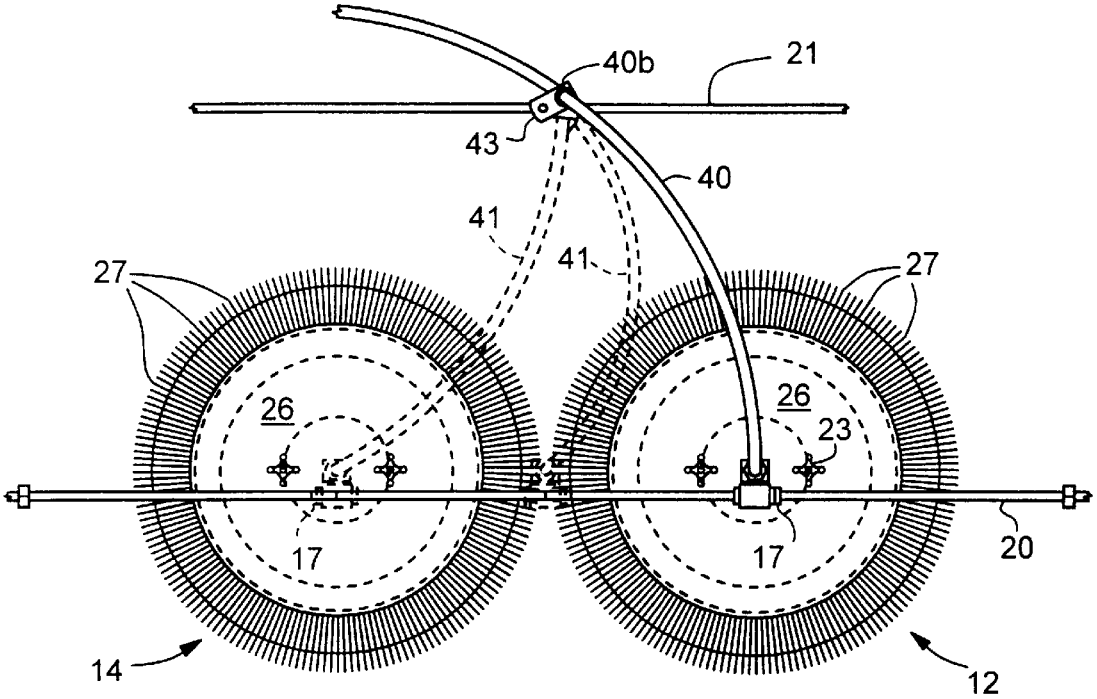
FIG. 3
FIG. 4
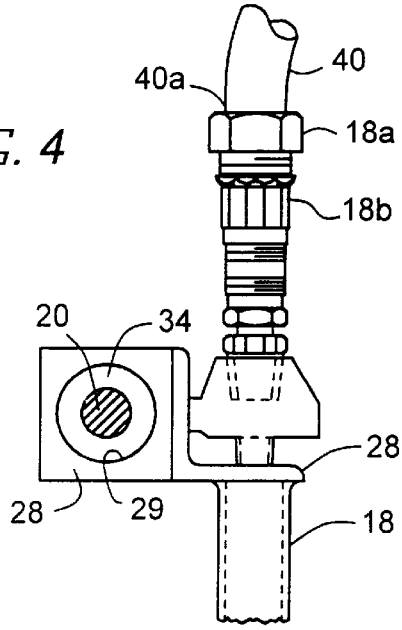

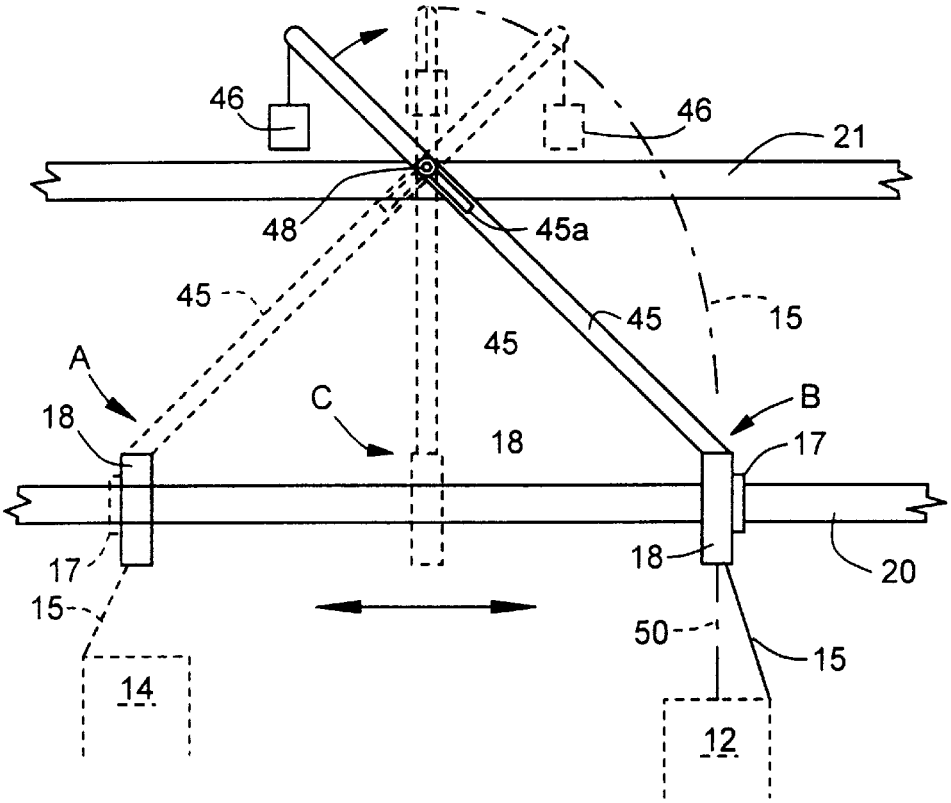
FIG. 13
FIG. 14
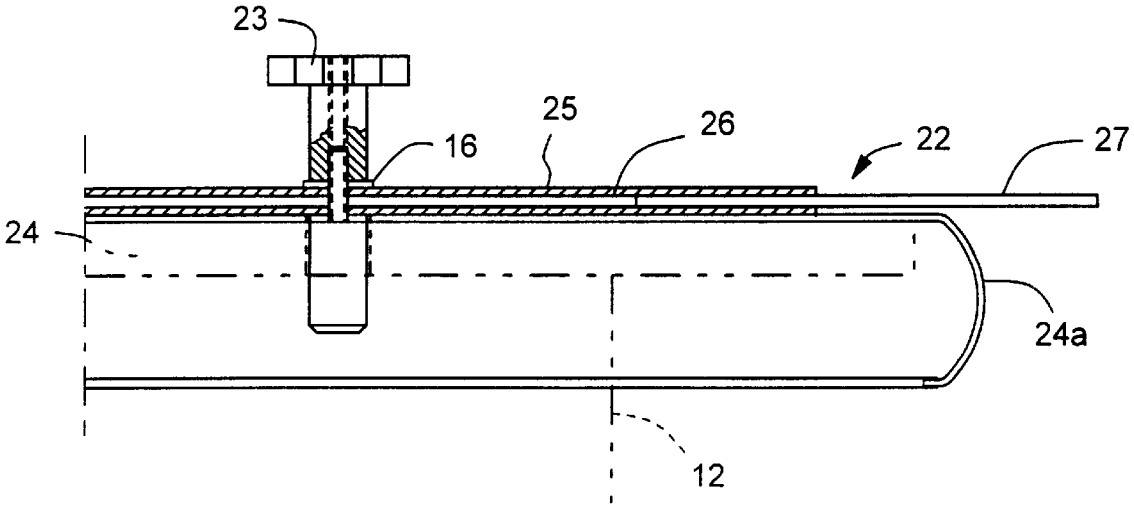

WIRE TRANSFER ASSEMBLY

BACKGROUND OF THE INVENTION

The present invention relates to a wire transfer assembly which provides for the continuous and uninterrupted removal of wire from adjacently positioned wire spools or reels.

In applications such as, but not limited to robotic welding, welding wire is supplied to the welding station by continuously withdrawing and removing the welding wire from a wire coil or spool. Robotic welding stations utilize massive amounts of welding wire and the coils or spools may vary in size from 40 to 50 pounds up to and exceeding about 1,000 pounds. Accordingly, it is very desirable to have as a source of welding wire an assembly which permits the continuous and uninterrupted withdrawal of wire from a wire source which will eliminate the need for stopping the welding operation while the empty coil, reel or spool is removed and a subsequent coil of welding wire is positioned and coupled to supply the welding station. Such downtime is expensive and substantially reduces the efficiency of the welding operation, particularly when the welding station is associated with and part of a continuously running assembly line.

In order to overcome the problems of stopping and replacing the wire coil or spool in wire handling operations, it has been suggested that adjacent coils or spools of filament wire may be secured together by attaching the trailing wire end from one coil to the leading wire end of another coil. Thus, when the wire is fully removed from one spool, then the second spool provides an uninterrupted and continuous supply of wire. However, in applying such a system to robotic welding operations, it has not been possible to readily position a wire guide coaxially with respect to the coil axis of each of the supply coils of wire. One attempt at a solution to this problem has involved a complicated coil or spool support system which is employed to somehow tilt the spool and direct the imaginary coil axis of each of the spools of wire to a fixed eyelet. However, such assemblies are complex, expensive and unworkable in welding wire systems because of the size of the welding wire spools, space limitations and the requirement that the welding wire entering the wire guide not have distortion imparted therein where the wire is passed over the edges of the wire guide.

Accordingly, the alignment of the wire guide coaxially with the coil axis is very desirable and important in robotic welding because the removal of welding wire from the wire spool through the wire guide must be substantially free of back tension and must not impart a cast or otherwise alter the shape of the wire during removal of the welding wire from the spool. When a cast is imparted to the withdrawn welding wire, the resultant flip, arc outages, inconsistent feed and misalignment at the welding electrode of the welding machine result in inadequate and imprecise welding operations oftentimes resulting in discarding or reworking of expensive parts.

Additionally, such prior art payoff or wire removal assemblies generally include complicated take-off assemblies which include a flyer arm and an eyelet which revolves about the coil axis to remove the wire from the coil. Such rotatable arm assemblies complicate and increase the difficulties in maintaining alignment of the upper wire guide removal unit with respect to the coil axis, particularly when continuous wire withdrawal from adjacent spools is desired. Accordingly, such assemblies have not been acceptable in handling welding wire in robotic welding operations.

SUMMARY OF THE INVENTION

One object of the present invention is to provide a wire transfer assembly for the continuous dispensing of welding wire from a spool and an adjacent spool.

Another object of the present invention is to provide an assembly for the continuous withdrawal of the filament of wire from an adjacent coil without interrupting the withdrawal of wire.

It is a further object of the present invention to provide a self contained wire guide alignment assembly which automatically positions, without the need for additional support devices or power, the wire guide member coaxially with respect to the spool axis to provide a substantially distortion free wire upon withdrawal of the wire from the spool.

It is still another object of the present invention to provide a wire payoff cap assembly which is readily positioned onto the flange of a spool of wire and which provides a uniform back tension to the wire being removed from the spool.

It is yet another object of the present invention to provide a framework assembly which permits a movable or slidable wire guide to be selectively positionable coaxially with the coil axis of the spool of wire from which the wire is being removed.

It is still a further object of the present invention to provide a wire payoff cap assembly which eliminates the need for adjustment of back tension devices to provide a uniform back tension on the wire being removed from the spool.

A further object of the present invention is a spool cap assembly comprised of a non-rotatable peripheral flange portion positioned about and encompassing the end of the spool flange and a non-rotatable brush member portion extending outwardly therefrom which provides a controlled back tension to the wire during removal of the wire from the wire spool.

In accordance with the present invention, the wire transfer assembly is comprised of a wire transfer assembly frame for slidably mounting and supporting a wire guide member coaxially of the axis of adjacent coils, spools or reels of wire. The transfer assembly frame permits the wire guide to be slidably mounted thereon such that when coils of wire are positioned side-by-side under the assembly frame, the wire guide member will slide or move along the transfer assembly frame to be positioned coaxially with respect to the spool axis of the spool supplying the wire. The coaxial positioning of the wire guide with respect to a first spool axis occurs while the wire is removed from the first spool or reel. During wire removal from the first spool, the wire guide member is biased against a stop member positioned on the transfer assembly frame is positioned substantially coaxially of the first wire spool axis. The unique wire transfer assembly in accordance with the present invention has particular application when the spools or reels contain welding wire which is removed therefrom through the wire guide member to a remote welding station. Because robotic welding stations may be located many feet from the welding wire supply, it is important that the wire guide member be positioned substantially coaxially of the coil axis from which the wire is being removed to minimize and to eliminate the back tension on the removed welding wire, as well as to minimize and to prevent the introduction of distortion to the wire as the wire is pulled from the spool through the wire guide member.

Before the wire being removed from one of the coils or spools nears the end thereof, the trailing end of the wire from the first spool is attached to the leading end of the wire on the adjacent positioned second coil or spool. Accordingly, when the wire is fully removed from the first spool or reel, the tension created by the welding wire entering the wire guide member from the second spool or reel overcomes the biased and positioned wire guide member to cause the wire guide member to slidably move on the wire transfer frame from a first position coaxially of the first reel or spool to a second position against a stop member where the wire guide member is substantially positioned coaxially of the axis of the second reel or spool. In such a position, the welding wire is readily removed from the second spool without distortion to the removed wire. During removal of wire from the second reel or coil, the first empty reel is removed from the assembly and another spool or reel of welding wire is positioned adjacent the spool from which the wire is being removed. Again, the trailing end of the wire coil in use is attached to the leading end of the adjacent new coil or spool to permit the wire to be continuously removed from the spools to the robotic welding machine.

To facilitate the ease and control of the removal of the wire from each of the wire spools or reels, a payoff assembly is provided and includes a flange portion which circumferentially encompasses the edges of the spool or reel flange. Preferably, the flange portion includes structure for centrally positioning a circular brush portion thereto. In one embodiment of the present invention, a pair of shafts or spindles are centrally mounted on the flange portion and adapted to receive and centrally position the circular brush portion to overlie the flange portion. The circular brush portion and the flange portion do not rotate when mounted to the reel or spool flange, with the flange portion encompassing the edge of the spool or reel of wire. The flange portion, is preferably, comprised of a surface which is smooth and wear resistant and which provides minimal resistance to the wire as it is directed over the flange surface during removal from the reel and through the wire guide member.

The brush portion of the payoff assembly includes a central disc portion having a plurality of filaments extending radially outwardly therefrom. The brush portion, comprised of elongated filament members, provides a controlled tension to the welding wire as the wire moves through the filaments and is removed from the spool or reel. The resistance provided by the radially extending filament members is sufficient to provide a back tension to the wire to prevent the wire from looping or collapsing upon the spool during cycle, start-stop operations, during scheduled downtime or otherwise stoppage of the wire transfer assembly.

The present invention consists also of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the present invention, there is illustrated in the accompanying drawings a preferred embodiment thereof, from an inspection of which, when considered in connection with the following description, the invention, its construction and operation, and many of its advantages will be readily understood and appreciated.

FIG. 3 is a top plan view of the continuous dereeling apparatus in accordance with FIG. 1;

FIG. 4 is an enlarged cross-sectional view of the biased slidable guide member in accordance with the embodiment of FIG. 1;

FIG. 13 is a front schematic view of the movement of the mechanically counter-balanced wire guide member in accordance with the embodiment shown in FIG. 12; and FIG. 14 is a cross-sectional view showing the payoff assembly portion of the dereeling apparatus in accordance with the present invention.

DESCRIPTION OF THE EMBODIMENTS

Figure 1:
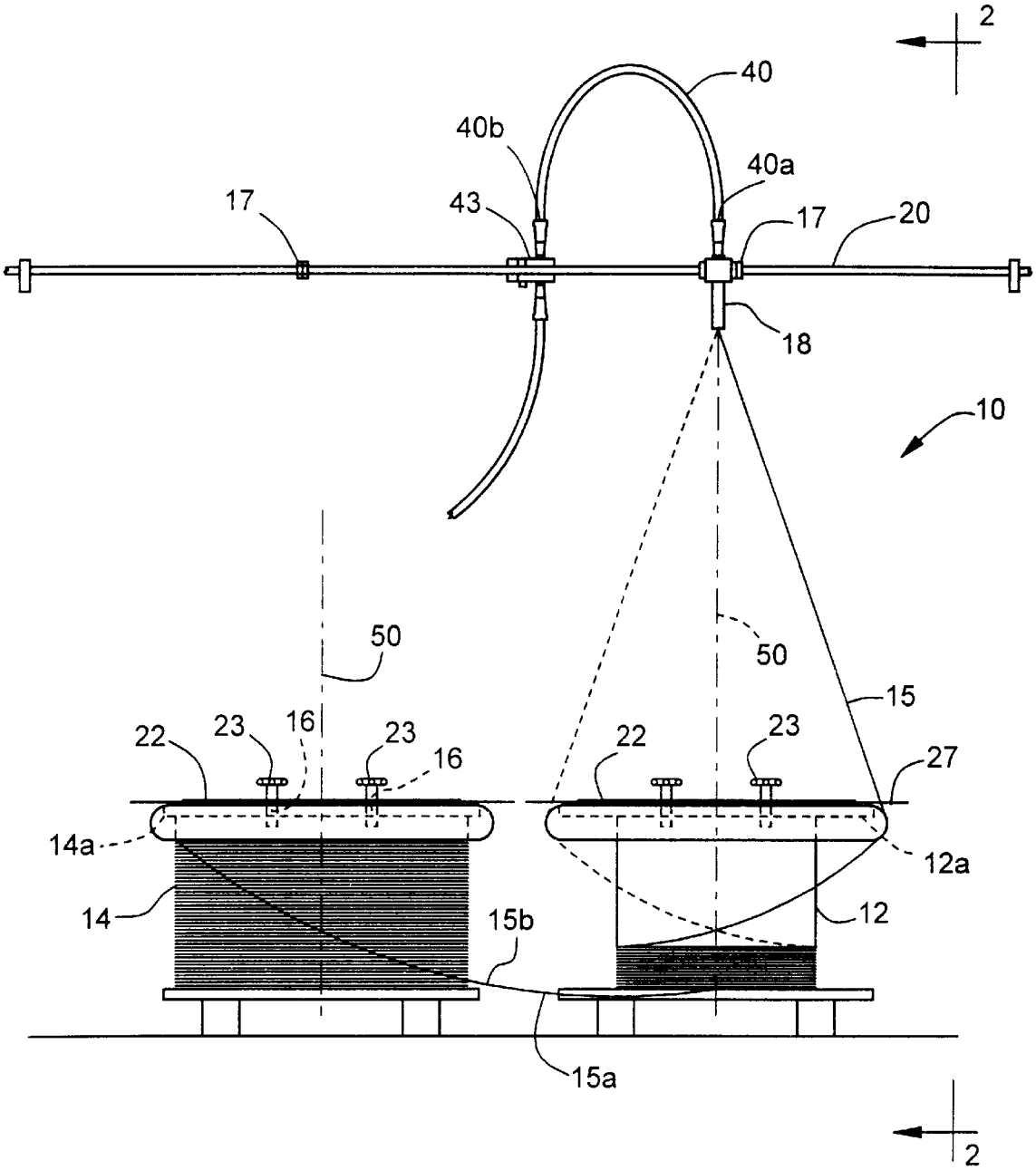
FIG. 1 is a front view of the continuous dereeling apparatus in accordance with one embodiment of the present invention.

Referring now to the drawings wherein like numerals have been used throughout the several views to designate the same or similar parts, in FIG. 1 a continuous dereeling apparatus or wire transfer assembly 10 is shown which includes side-by-side reels 12 and 14 from which welding wire 15 is to be removed. As shown in FIG. 1, the welding wire 15 is being removed from the reel or spool 12 and is being pulled upwardly through a wire guide member 18 which is slidably mounted on a frame member 20, as will hereinafter be described.

As shown in FIGS. 1–3, 5–7, 9–11 and 14, the dereeling apparatus 10 further includes payoff assemblies 22 which are provided for mounting to the upper reel flanges 12*a* and 14*a*, respectively, of reels or spools 12 and 14. As shown in FIG. 14, each payoff assembly 22 is comprised of a radially extending flange portion or member 24 which is adapted to encompass and to fit over the edges of the reel flanges 12*a* and 14*a* of the respective reels. Furthermore, the payoff assembly includes a circular brush portion or member 25 mounted to the flange portion 24 and radially extending outwardly therefrom. A plurality of pin members 23 are provided for positioning, mounting and locating the flange portion 24 of the assembly 22 on the reel flanges 12*a* and 14*a*. The reel flanges 12*a* and 14*a* include a plurality of openings 16 therein which cooperate and permit the mounting of the payoff assembly to the reel flange by inserting pin members 23 into the openings 16 of the reel flange.

The circular brush portion or member 25 (FIG. 14) includes a central disc member 26 having a plurality of brush fingers or filaments members 27 radially extending outwardly therefrom. The brush finger members or tines 27 and the central disc member 26 are, preferably, in a single plane and neither the flange portion or the brush portion revolve when mounted to the flange of the spool or reel. The flange portion 24 is comprised of a surface portion 24*a* which presents a smooth surface which provides minimal resistance to the wire 15 during removal from the reel. The surface may include a smooth surface of polished metal.

As shown in FIGS. 1–3, 5–7 and 9–11, the wire 15 is being removed through the wire guide member 18 from reel 12. The wire 15 has a trailing end 15*a* attached to the leading end 15*b* of the welding wire contained on coil or reel 14. Thus, when the wire is withdrawn over the surface portion 24*a* of the flange or member portion 24 of the payoff assembly 22, the wire is engaged by the brush fingers 27 to provide a suitable holding tension to the wire when the removal of the wire is interrupted from the spool or reel. The wire is pulled to a robotic welding gun or station (not shown) which is located remote from the wire source. As the wire is pulled from the reel, the wire enters the wire guide member 18 which is positioned substantially coaxially with the axis (denoted 50) of the respective spool or reel 12 or 14, as shown in FIGS. 1, 5, 9 and 12 of the drawings.

The continuous dereeling apparatus 10 includes a frame member 20 upon which the wire guide member 18 is slidably mounted and an auxiliary support member 21 (FIG. 2) which stabilizes and provides for the pivotal movement of the wire guide member 18 and associated conduit 40 from one position where the guide member is coaxially aligned with the axis of one spool to a second position where the guide member is coaxially aligned with the axis of another spool when the trailing end of the wire is fully removed from the first reel or spool and the leading end of the wire on the adjacent second reel is then removed through the guide wire member 18. As shown in FIG. 4, the guide member 18 is comprised of an L-shaped bracket member 28 which has an opening 29 therein adapted to receive a bushing member 34 which is comprised of a teflon, other resistance free material or bearing structure. The bushing 34 is sized and adapted to engage the frame member 20 and to permit the guide member 18 to travel back and forth upon the frame member 20 in a substantially resistant-free manner.

Figure 2:
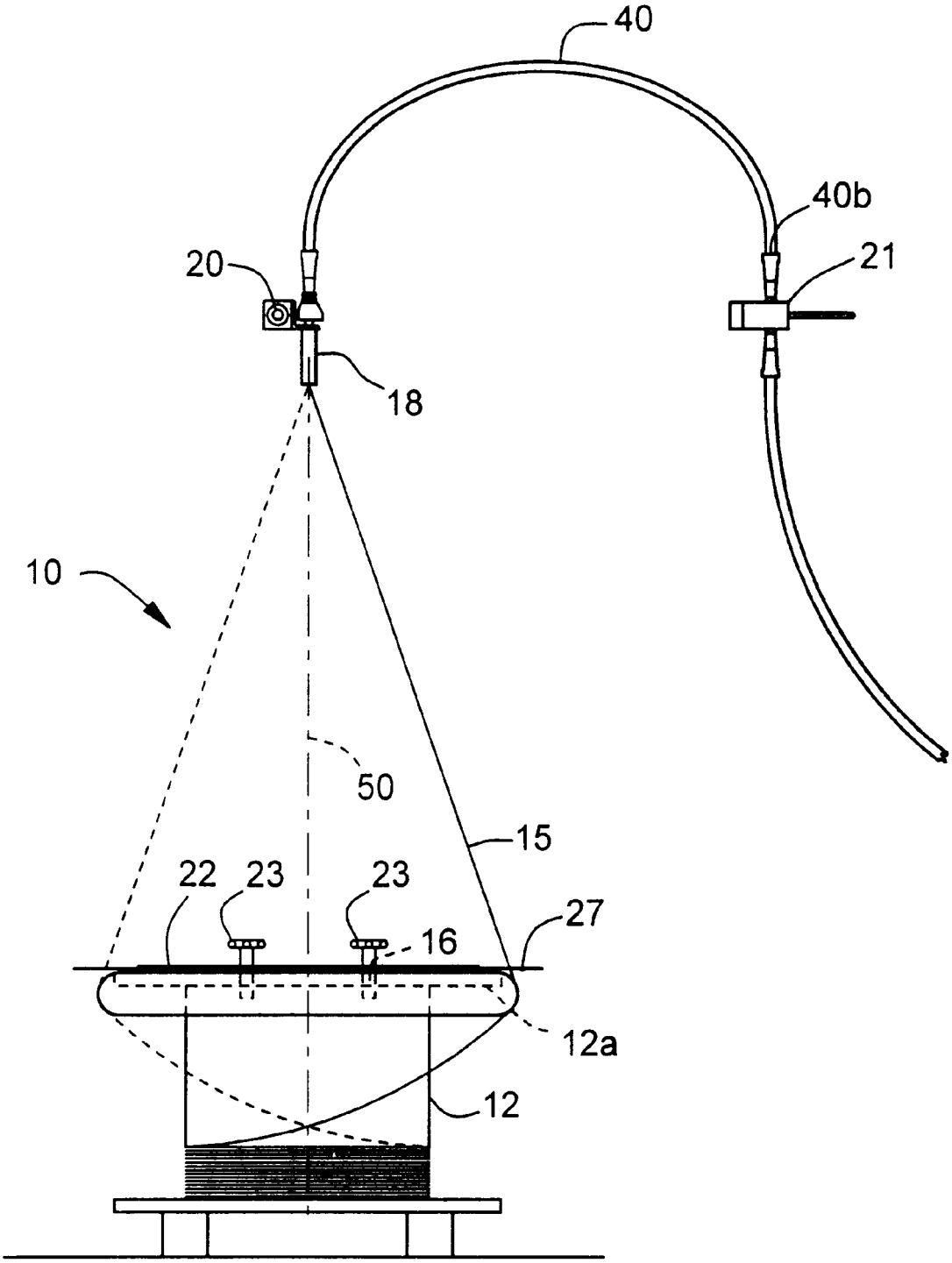
FIG. 2 is a cross-sectional view taken through lines 2—2 of FIG. 1.

In one embodiment of the present invention, the guide member outlet 18*a* and guide member coupling or bearing 18*b* of the upper guide member 18 slidably mounted on frame member 20 is attached to a flexible conduit member 40 which is pivotally anchored to the auxiliary support member 21 (FIG. 2). The conduit 40, substantially linear when unconfined, has an inlet end 40*a* mounted to the guide member outlet 18*a* and rotatable coupling 18*b* and an outlet end 40*b* pivotally anchored to the auxiliary support member 21. The conduit 40 has a predetermined arc between the anchored inlet and outlet ends. This predetermined arc of the conduit provides an outward biasing force which positions and maintains the guide member 18 against stop member 17 mounted on frame member 20. The stop members 17 facilitate positioning of the guide member 18 during wire removal substantially coaxial with the axis of the coil from which wire is being withdrawn. The spring tension range of the predetermined arc of the conduit ranges between a minimum of about 0.5 lbs. to a maximum of about 5 lbs. to maintain the guide member against stop 17. The preferred tension is about 1.5 lbs. When the last convolution of wire or the trailing end 15*a* of wire from the first coil is removed, the first convolution of wire is started to be removed from the adjacent second coil and the back tension on the wire engaging the guide member causes the guide member to overcome the spring tension of the conduit and slide along the support frame member 20 until the guide member engages stop 17 and is coaxially aligned with the coil axis of the second wire coil, as shown in FIG. 3.

Accordingly, the back tension on the wire resulting from the wire engaging the brush filament 27 from the adjacent second wire coil is sufficient to overcome the biasing force provided by the predetermined arc of the conduit on the upper guide member to permit the guide member to be shifted coaxially from the axis of one coil to another. Thus, the shifting movement of the guide member 18 along the frame member 20 between positions coaxially of the coil axis of the coils is controlled and maintained by the force of the length of the arc of the conduit 40 between the wire guide outlet end 18*a* and the conduit outlet end 40*a* which is pivotally mounted to axially support member 21. The outlet end of the conduit 40*b* is pivotally anchored by bracket 43 to the auxiliary support frame 21 at a point substantially intermediate the distance between the coil axis 50 of coils 12 and 14. This structure permits an over-center biasing action to be provided by the arc of the confined conduit which imparts to the conduit the memory to return to its substantially linear configuration.

Thus, during removal of the wire 15 from a coil of wire, the arc and tension forcer on the guide member positions and maintains the guide member against stop 17 coaxially of the coil axis. When the leading convolution of wire from an adjacent coil is removed, the back tension or drag encountered between the removed wire entering the guide member creates a force on the guide member which is greater than the biasing force imposed on the guide member, causing the guide member 18 to be positioned against stop 17 coaxially above with the new coil axis. As shown in FIG. 3, the movement of the guide member 18 and conduit 40 between coaxial positions with respect to coil 14 and the adjacent coil 12 is illustrated. As shown in dotted lines 41, the conduit attached to guide member 18 moves along frame member 20 to a final position wherein the guide member engages stop 17 and is positioned coaxially of the axis of coil 12. The outlet end 40*b* of the conduit 40 is pivotally mounted to bracket 43 mounted on support member 21, intermediate the axis of coils 12 and 14, as shown in FIGS. 1 and 3.

Another embodiment of the present invention is shown in FIGS. 5–8, wherein the guide member 18 is secured to a biasing member 30 which is pivotally anchored by bracket 43 to the auxiliary support member 21. The biasing member 30 includes a central shaft 31, a spring member 32 and a tensioning device or stop 33, which permits adjustment of the biasing member 30 to maintain the proper tension on the guide member 18 to maintain the guide member positioned substantially coaxially of the axis of coil reel during the removal of the wire from the particular coil or reel.

Figure 5:
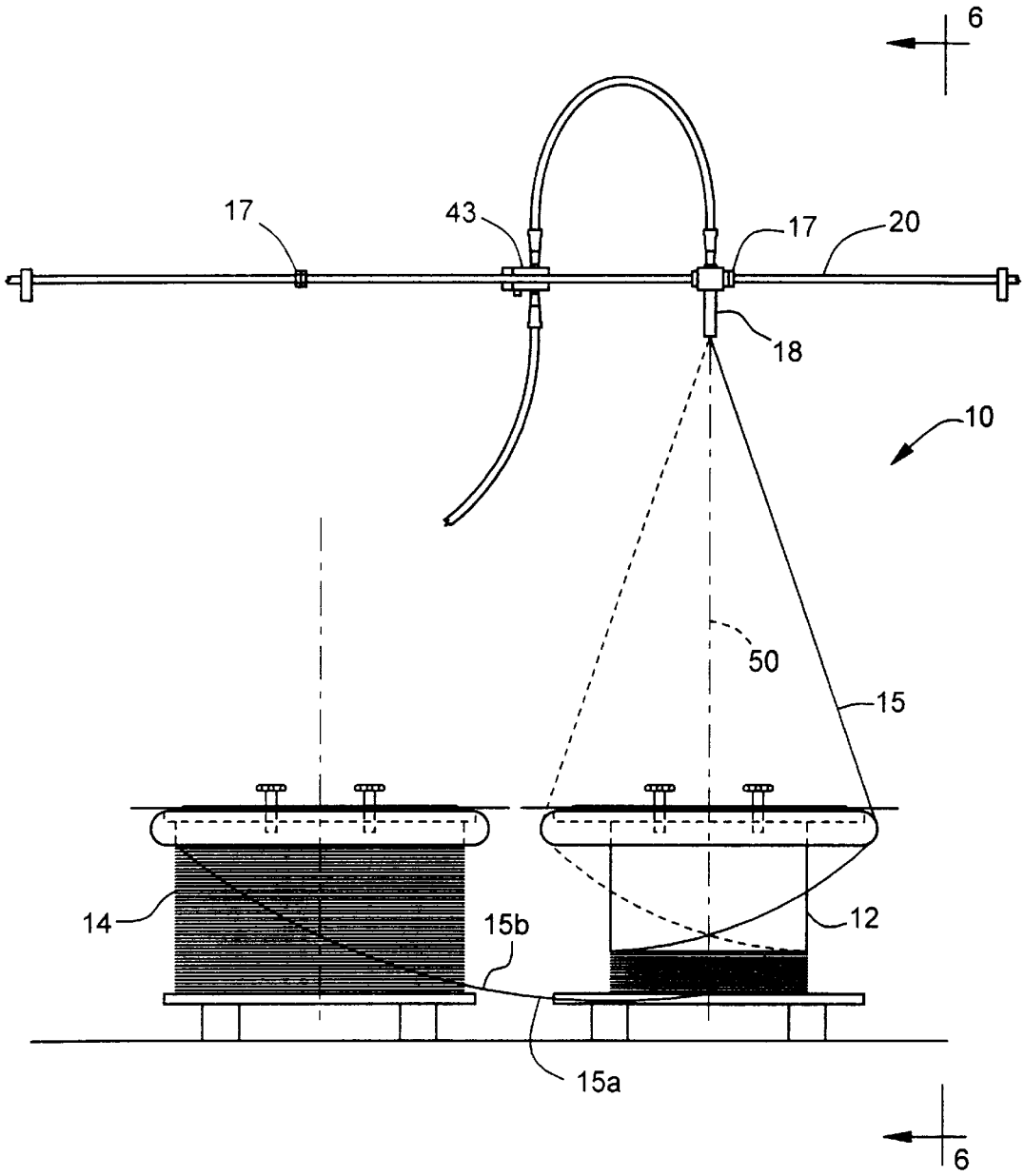
FIG. 5 is a front view of the continuous dereeling apparatus in accordance with a further embodiment of the present invention.
Figure 6:
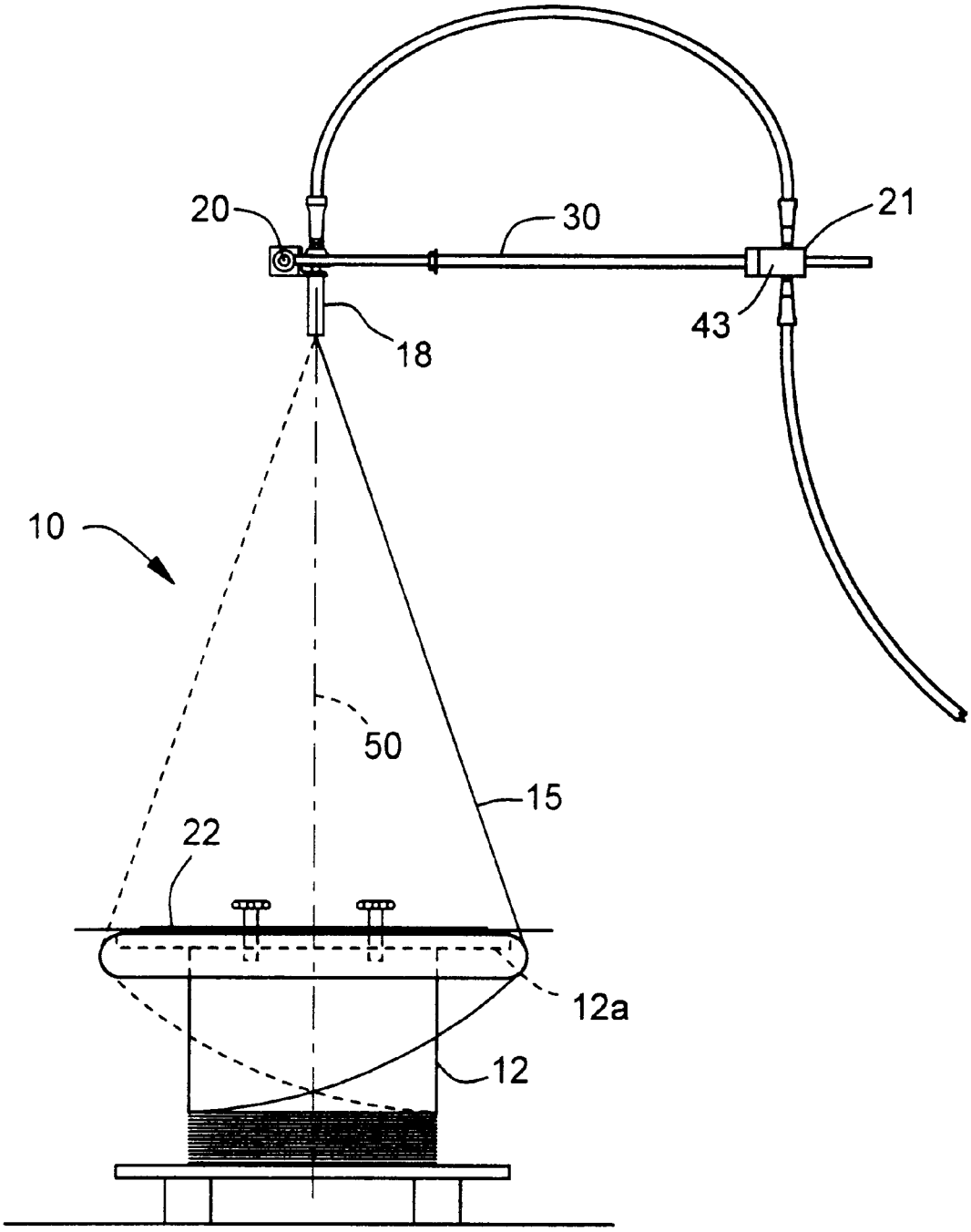
FIG. 6 is a cross-sectional view taken through lines 6—6 of FIG. 5.
Figure 7:
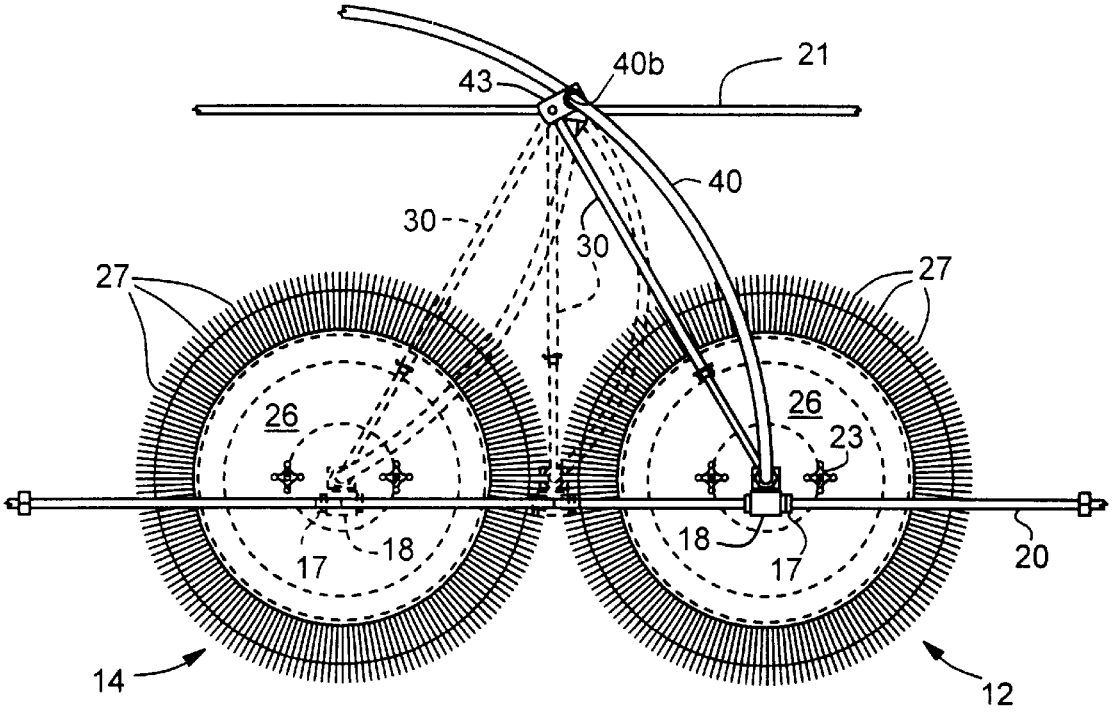
FIG. 7 is a top plan view of the continuous dereeling apparatus in accordance with FIG.5.
Figure 8:
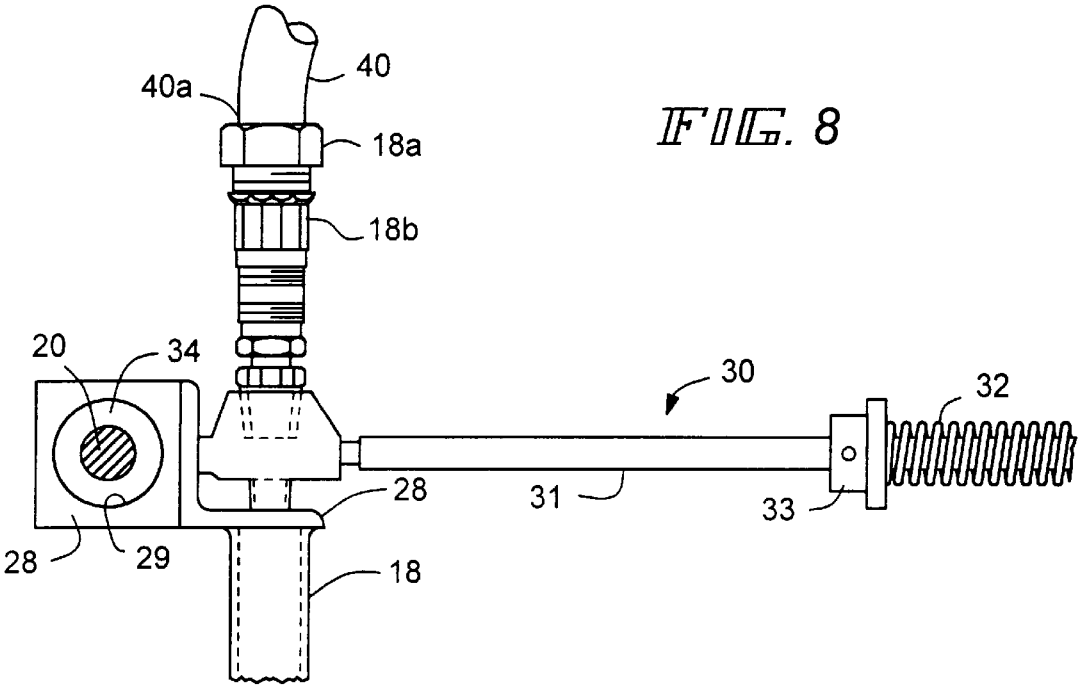
FIG. 8 is an enlarged cross-sectional view of the biased slidable guide member in accordance with the embodiment of FIG. 5.

In FIG. 7, the movement of the guide member 18 and the biasing member 30 during transfer of the wire from the trailing wire end 15*a* of reel 14 to the leading wire end 15*b* of reel 12 results in the movement of the biasing member 30 from a fully extended position, wherein the guide member is coaxially located with respect to the coil axis of coil 14, to a position where the guide member 18 is coaxially positioned with respect to the coil axis of reel 12. Thus, the biasing member 30 maintains the guide member 18 against stop 17 and the spring tension, asserted by the biasing member, is sufficient to maintain the guide member 18 in position coaxially of the coil axis. When the wire being removed changes from one reel to another reel, the pulling force of the welding wire through the guide member 18 overcomes the spring tension of the biasing member 30 to permit the guide member to slidably move upon the frame member 20 to a position wherein the guide member 18 is positioned coaxially of reel 12, as shown in FIGS. 5 and 7. The guide member 18 cooperates with an upper guide tube or conduit 40 through which the welding wire is pulled and removed, which tube is directed to a robotic welding machine, not shown. It should be noted that the conduit 40*b* does not need to be attached or located at the pivot area or bracket 43 on auxiliary frame 21.

Figure 9:
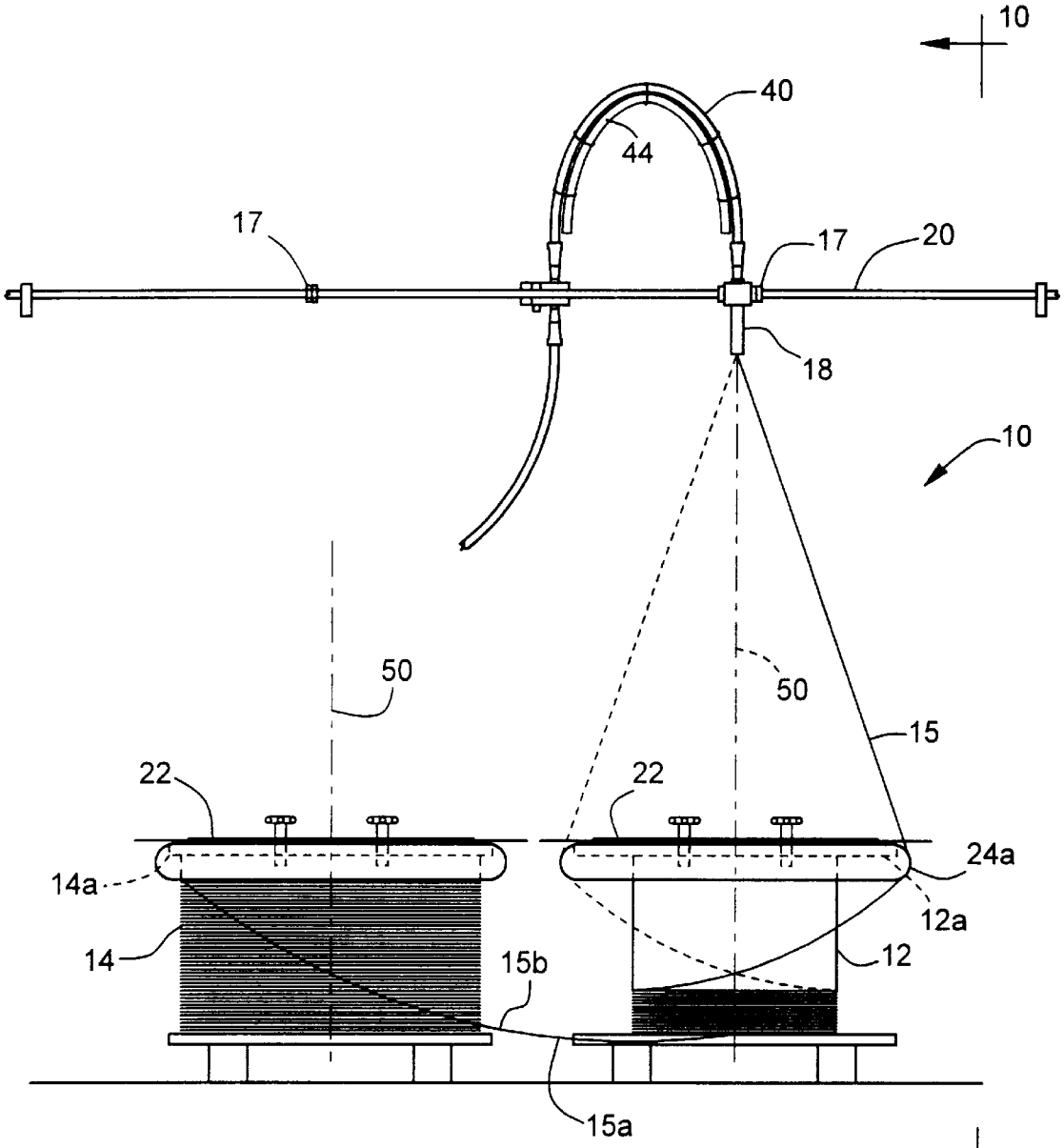
FIG. 9 is a front view of the continuous dereeling apparatus in accordance with still another embodiment of the present invention.
Figure 10:
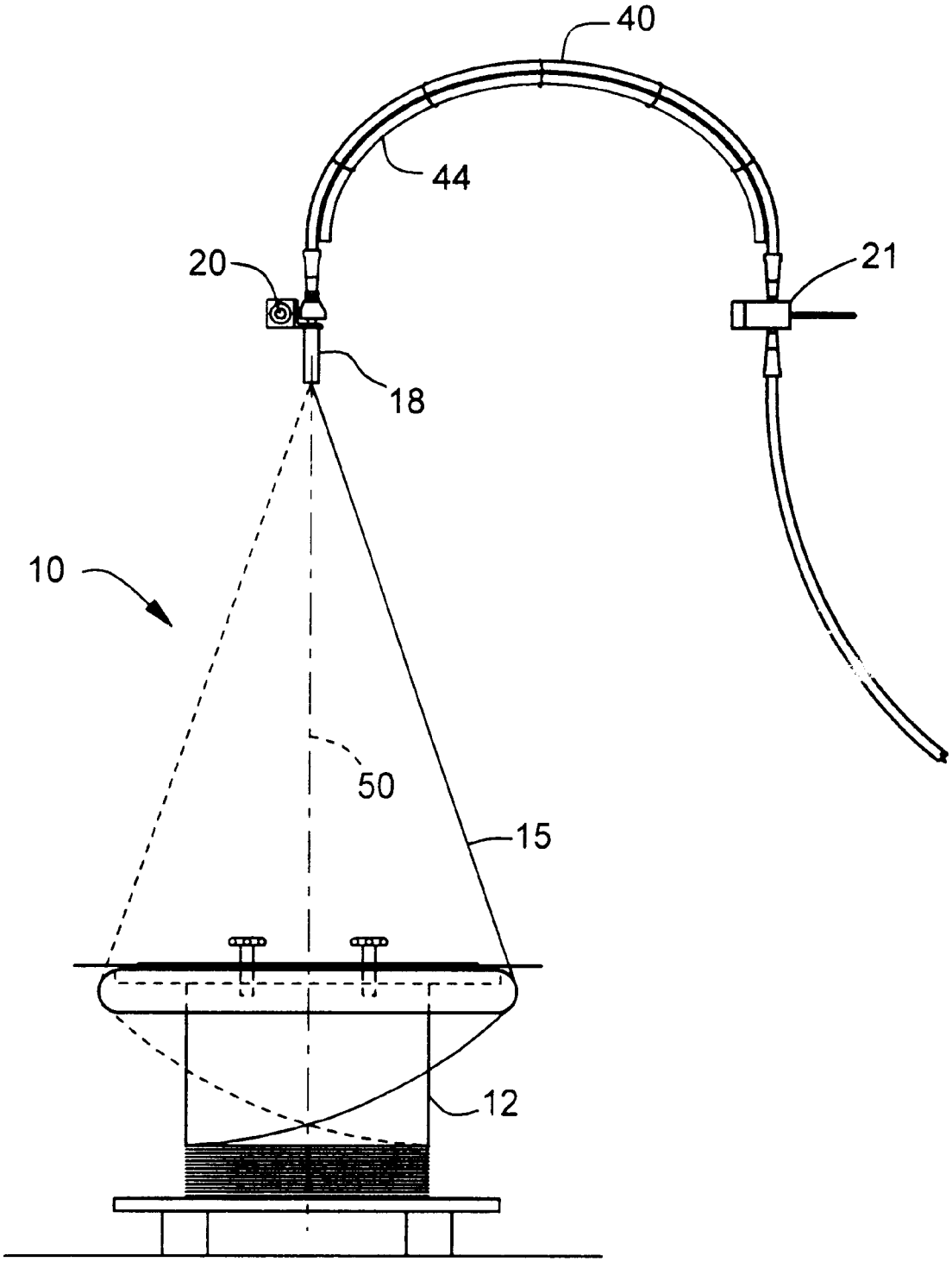
FIG. 10 is a cross-sectional view taken through lines 10—10 of FIG. 9.
Figure 11:
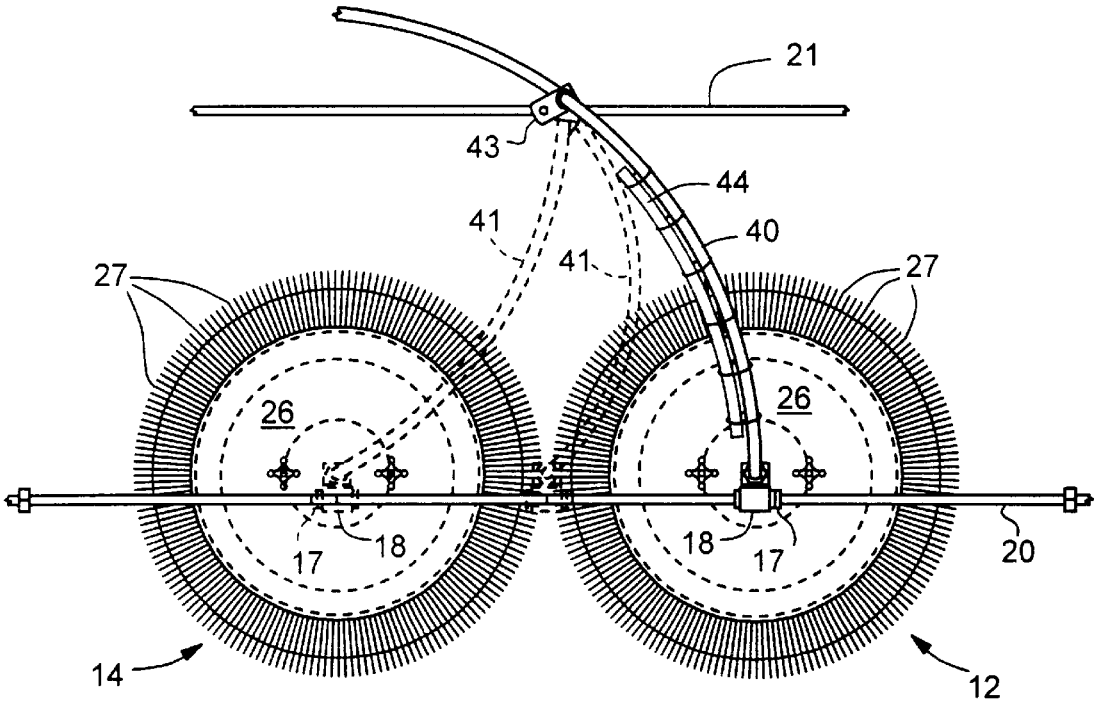
FIG. 11 is a top plan view of the continuous dereeling apparatus in accordance with FIG. 9.

In still a further embodiment of the present invention, as shown in FIGS. 9–11, the guide member 18 and conduit 40 includes a leaf spring member 44 associated therewith which imparts a tension to the guide member to position the member substantially coaxially the coil axis from which wire is being removed. Again, the leaf spring 44 imparts a spring tension of between about 0.5 to 5 lbs. on the guide member 18. As shown in FIG. 11, the movement of the guide member 18 and conduit 40 between coaxial positions with respect to coil 14 and adjacent coil 12 is illustrated. As shown in dotted lines 41, the conduit 40 attached to guide member 18 and associated with leaf spring member 44 moves along frame member 20 to a final position wherein the guide member engages stop 17 and is positioned coaxially of the axis of coil 12. The outlet end 40 of the conduit is pivotally mounted to bracket 43 mounted on support member 21 intermediate the axis of coils 12 and 14, as shown in FIGS. 9 and 11.

Figure 12:
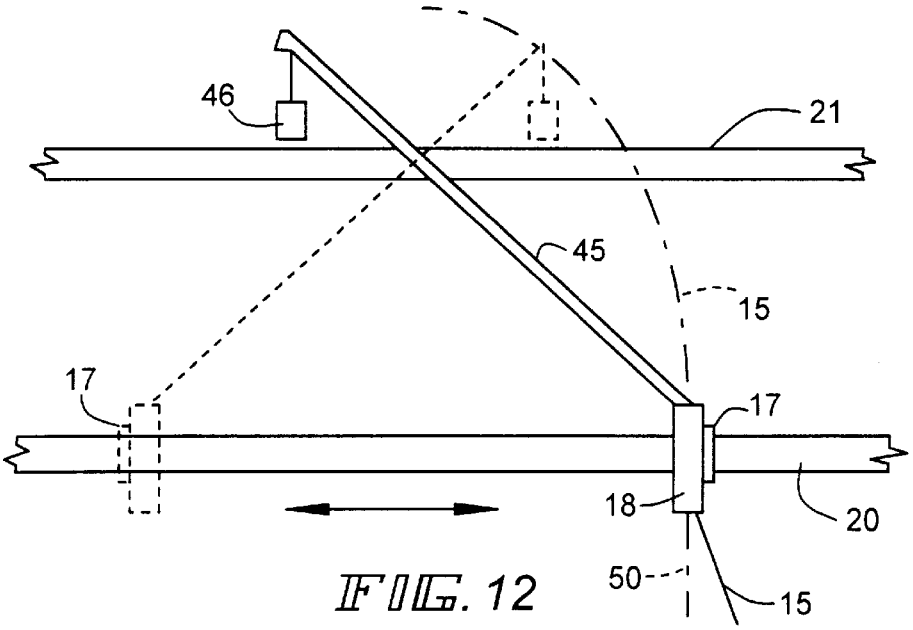
FIG. 12 is a front schematic view of a continuous dereeling apparatus illustrating a mechanically counter-balanced guide member in accordance with one embodiment of the present invention.

In yet another embodiment of the present invention, FIGS. 12 and 13 schematically illustrate a mechanically counter-balanced structure for the sliding movement of the guide member 18 between positions substantially coaxial with respect to the coil axis. The guide member 18 is coaxially centered over a coil (not shown), with the wire 15 being directed through the guide member 18. The wire 15 may exit the guide member 18 in any direction through a conduit (not shown). The guide member 18, as discussed before, is pivotally attached to one end of a lever 45, with the other end of the lever attached to a hanging weight 46. The lever includes a channel opening 45a which is pivotally mounted by pin 48 to support frame 21 intermediate the stop members 17. When the last convolution of wire 15 is removed from one coil, the first convolution of wire causes the guide member 18 to move from position A to position B. When the movement of the guide member 18 is substantially equal distance between the coils 12 and 14, as shown by position C in FIG. 13, the hanging weight is suspended vertically. Further movement of the guide member 18 and lever 45 overcomes the counter-balance force and moves to position B, as shown in the dotted lines. In such a position, the guide member 18 engages stop 17 and is substantially position coaxially of coil axis 50 of coil 12.

The utilization of the mechanical counter-balance structure provides a force on the guide member 18 that is substantially less than spring biased systems. Such a structure would have advantages when fine wires are being removed from the coils.

As shown in drawings and in particular FIG. 14, the payoff assembly 22 includes a flange portion 24 which is a smooth arcuate shaped structure which permits the wire to be readily pulled over the surface thereof and through to the guide member. Neither the flange portion 24 nor the brush portion 25 rotate when they are mounted to the reel flanges 12*a* and 14*a*. The circular brush member 25 and radially extending tines or brush fingers 27 provide a sufficient back tension to the wire to maintain the wire in a proper location on the coil to prevent entanglements on stopping and starting during withdrawal of the wire from the respective coil or reel.

Importantly, it is within the scope of the present invention that although the guide member 18 is slidably mounted on frame member 20 by a L-shaped member having a plastic or telfon bearing or bushing structure, any type cross-sectional configuration of the frame member which permits the slidable movement of the guide member back and forth over the coil axis of each of the respective coils is within the scope of the present invention. Also, it should be noted that the wire exiting the guide member may be directed in any direction at any location including the pivot location on auxiliary member 21, except for the embodiment utilizing the arc tension of the conduit tube 40.

What is claimed is:

1. A wire dereeling assembly for the continuous removal of wire from at least two reels of wire positioned with respect to one another, including in combination:

a frame assembly positioned above the at least two reels, said frame assembly including a frame member located substantially perpendicular to a centerline extending through the reel axis of each of the at least two reels of wire;

first and second stop members structurally arranged to cooperate with said frame member; and a guide member structurally arranged to be mounted to said frame member and operable between a first position against said first stop member wherein said guide member is positioned substantially coaxial with the reel axis of one of at least two reels of wire and between a second position against said second stop member wherein said guide member is positioned substantially coaxial with the reel axis of the other of the at least two reels of wire.

2. The wire dereeling assembly in accordance with claim 1, further including a non-rotatable payoff cap assembly mountable to the upper flange of the at least two reels of wire, said payoff assembly comprised of a flange portion and a brush portion, with said flange portion mounted to the upper flange of the at least two reels of wire and said brush portion being engaged by the wire during removal from the at least two reels of wire.

3. The wire dereeling assembly in accordance with claim 2, wherein said flange portion and said brush portion of said payoff assembly are positioned substantially in a single plane.

4. In the wire dereeling assembly in accordance with claim 2, wherein said flange portion includes a substantially friction-free arcuate surface which facilitates wire removal from the reel.

5. The wire dereeling assembly in accordance with claim 1, wherein said frame assembly further includes an auxiliary frame member positioned substantially on the same plane as said frame member, the wire dereeling assembly further including biasing means pivotally anchored to said auxiliary frame member and structurally arranged to be engageable with said mounted guide member to maintain said guide member either at said first or said second positions.

6. The wire dereeling assembly in accordance with claim 5, wherein said tension force exerted by said biasing means on said mounted guide member is between about 0.5 to 5 lbs.

7. The wire dereeling assembly in accordance with claim 5, wherein said tension force exerted by said biasing means on said mounted guide member is about 1.5 lbs.

8. The wire dereeling assembly in accordance with claim 5, wherein said biasing means is a conduit tube having a predetermined arc, one end of said conduit being engageable with said guide member and the end opposite said one end pivotally secured to said auxiliary frame member, with said conduit tube possessing a memory for a liner relaxed configuration.

9. The wire dereeling assembly in accordance with claim 5, wherein said biasing means is a spring tension assembly having one end pivotally secured to said auxiliary frame member and the end opposite said one end structurally arranged to be engageable with said guide member.

10. The wire dereeling assembly in accordance with claim 9, wherein said spring tension assembly is adjustable.

11. The wire dereeling assembly in accordance with claim 5, wherein said biasing means includes a weight secured to one end of a lever member, with the end of said lever opposite said one end being engageable with said guide member, with said lever being pivotally secured to said auxiliary frame member for pivotal movement with said guide member between said first and said second positions.

12. The wire dereeling assembly in accordance with claim 1, wherein the dereeling assembly includes biasing means pivotally anchored to said frame assembly and structurally arranged to be engageable with said guide member to maintain said guide member either at said first or said second positions.

13. The wire dereeling assembly in accordance with claim 12, wherein said tension force exerted by said biasing means on said mounted guide member is between about 0.5 to 4 lbs.

14. The wire dereeling assembly in accordance with claim 12, wherein said tension force exerted by said biasing means on said mounted guide member is about 1.5 lbs.

15. The wire dereeling assembly in accordance with claim 12, wherein said biasing means is a conduit tube having a predetermined arc, one end of said conduit being engageable with said guide member and the end opposite said one end pivotally secured to said frame assembly, with said conduit tube possessing a memory for a linear relaxed configuration.

16. The wire dereeling assembly in accordance with claim 12, wherein said biasing means is a spring tension assembly having one end pivotally secured to said frame assembly and the end opposite said one end structurally arranged to be engageable with said guide member.

17. The wire dereeling assembly in accordance with claim 16, wherein said spring tension assembly is adjustable.

18. The wire dereeling assembly in accordance with claim 12, herein said biasing means includes a weight secured to one end of a lever member, with the end of said lever opposite said one end being engageable with said guide member, with said lever being pivotally secured to said frame assembly for pivotal movement with said guide member between said first and said second positions.

* * * * *